US006490424B2

(12) United States Patent
Okamoto

(10) Patent No.: US 6,490,424 B2
(45) Date of Patent: Dec. 3, 2002

(54) CLEANING MECHANISM FOR AN INTERMEDIATE TRANSFER BODY IN AN IMAGE FORMING APPARATUS

(75) Inventor: Masaya Okamoto, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/767,147

(22) Filed: Jan. 23, 2001

(65) Prior Publication Data

US 2001/0009617 A1 Jul. 26, 2001

(30) Foreign Application Priority Data

Jan. 24, 2000 (JP) ..... 2000-014984

(51) Int. Cl.[7] ..... G03G 15/16
(52) U.S. Cl. ..... 399/101; 399/297
(58) Field of Search ..... 399/101, 297, 399/302, 307, 308

(56) References Cited

U.S. PATENT DOCUMENTS 5,970,281 A * 10/1999 Park ..... 399/101
6,026,271 A * 2/2000 Saitoh ..... 399/308
6,186,066 B1 * 2/2001 Kim ..... 399/101 X
6,263,176 B1 * 7/2001 An et al. ..... 399/101

FOREIGN PATENT DOCUMENTS

JP 62-286082 12/1987
JP 4-16978 1/1992

* cited by examiner

*Primary Examiner*—William J. Royer
(74) *Attorney, Agent, or Firm*—Young & Thompson

(57) ABSTRACT

A cleaning mechanism for an image forming apparatus has a cleaning roll that contacts an intermediate transfer body under pressure with a predetermined load and rotates with the intermediate transfer body for removing residual ink, toner or impurities on the intermediate transfer body after a transfer process. A sheet member is urged onto the cleaning roll for slip contact with a predetermined load.

5 Claims, 5 Drawing Sheets

CLEANING MECHANISM FOR AN INTERMEDIATE TRANSFER BODY IN AN IMAGE FORMING APPARATUS

BACKGROUND OF THE INVENTION

1. Field of the Invention

The present invention relates to a cleaning mechanism for an image forming apparatus. More particularly, the invention relates to a cleaning mechanism for an image forming apparatus for cleaning an intermediate transfer body used upon formation of an image in an electrophotographic apparatus.

2. Description of the Related Art

In an electrophotographic apparatus or the like, a toner image is electrostatically carried on a transfer member. After transfer, a substantial amount of toner resides on a surface of a photoconductor (transfer ratio is about 80 to 90%), thereby lowering image density. On the other hand, since the toner is transferred electrostatically, it is not possible to completely prevent flying toner that may degrade the clearness of the image or contaminate the inside of the apparatus. For avoiding such defects, there has been proposed a pressure type transfer means. This type of apparatus employs appropriately 200 kg/cm$^2$ of pressure for transferring and fixing the image. It is difficult to directly transfer the toner image on the surface of the photoconductor onto a medium to be printed and it is necessary to transfer the electrostatic latent image to a dielectric layer as an intermediate transfer body. Therefore, the apparatus can become bulky and the mechanism can be complicated. Also, when transferring the electrostatic latent image, the resolution image can be lowered.

On the other hand, there has been proposed an apparatus for developing the latent image formed on the photoconductor and transferring the developed image to an intermediate transfer body having a silicon rubber layer, and then transferring the transferred image onto a medium to be printed, which medium will be hereinafter referred to as a "printing medium". However, such apparatus requires a large amount of heat energy for transferring and fixing the image. Also, the heat inherently elevates the temperature of the photoconductor via the intermediate transfer body, and thus the characteristics of the photoconductor may possibly be degraded.

A conventional cleaning mechanism of an image forming apparatus will be discussed in detail with reference to FIG. 6.

FIG. 6 is a side elevation showing the first prior art disclosed in Japanese Unexamined Patent Publication No. Showa 62-286082. In FIG. 6, an intermediate transfer body 503 is in belt form which is formed by coating a surface of a rigid roll of stainless or the like with a silicon rubber or the like.

The intermediate transfer body 503 is clamped between a cleaning roll 501 heated by an internal heater and a pressure roll 507 positioned in opposition to the cleaning roll 501 and is fed therethrough. Thus, a residual toner 508 on the intermediate transfer body 503 is melted by the cleaning roll 501 and deposits thereon. On the cleaning roll 501, a cleaning blade 504 which is formed with a thin plate of stainless steel or phosphor bronze, is contacted under pressure exerted by a spring 505 for removing the toner depositing on the surface thereof. The toner thus scraped is received in a waste toner box 509. On the other hand, in order to prevent the waste toner from scattering, a sheet 506 formed with a heat resistant resin film, such as polyimide film or the like, is urged onto the cleaning roll 501.

The toner on the intermediate transfer body 503 is softened to a certain extent by heat and pressure applied from the cleaning roll 501. Furthermore, since a surface free energy of the surface of metal is greater than that of the silicon rubber, softened toner is efficiently deposited on the surface of the metal of the cleaning roll 501. Furthermore, the softened toner is removed by pressure after passing through a nip portion between the cleaning roll 501 and the pressure roll 507 to be quickly hardened to be easily removed by the metallic cleaning blade 504.

One employing a cleaning belt in place of the cleaning roll 501 for removing residual ink or stains or dirt on the surface of the transfer body may possibly cause fluctuations in pressure when the cleaning belt contacts the transfer body. Also, for low absorbing speed ink, fluctuation may be caused in removal of residual ink or stains or dirt on the surface of the transfer body to form a stain on the printed product.

FIGS. 7A and 7B are a perspective view and a side elevation of the second prior art disclosed in Japanese Unexamined Patent Publication No. Heisei 04-016978, for example.

A cleaner 613 is constructed with a cleaning puff 610, a cleaning roll 622 and a take-up roll 631. A cleaning agent supplier 609 is formed with a plurality of conduits or one or more grooves to impregnate a cleaning agent stored therein into the cleaning puff 610. The impregnating method of the cleaning agent in the cleaning puff 610 may be capillary force, a pressure difference between inside and outside of the cleaning agent supplier 609, difference of concentration of the cleaning agent, heating by an electric heater, ultrasonic vibration or pumps.

The cleaning puff 610 impregnated with the cleaning agent is pressed onto a photoconductor drum 606 by the cleaning roll 622 in the vicinity of an ink absorbing portion 620. The cleaning puff 610 absorbing contaminants is taken up by the take-up roll 631. After absorbing contaminants, the cleaner 613 may rewind the almost dried cleaning puff 610 to the cleaning agent supplier 609 for reuse. Furthermore, when the same image is to be printed for a plurality of sheets simultaneously, cost may be saved by performing cleaning at a given interval or by reducing the impregnating amount of the cleaning agent.

The cleaning puff 610 may be formed with fabric paper, cloth, or plastics. However, by containing metallic or ceramic fiber, removal of static electricity or removal of solid deposits may be expected. On the other hand, the cleaning puff 610 may be formed from a porous sheet or sheet working into a particular pattern.

The cleaning agent is made of a material which may solve an ink to be used for printing. For example, in case of water soluble ink, a mixture prepared by adding a surface active agent and an antioxidant to solution of higher alcohols or glycol esters is taken as a primary component. In addition, depending upon composition of the ink, amines, ethyl's or other esters may be used.

On the other hand, when a dispersion type ink which is prepared by dispersing a pigment into a liquid component, a solvent having the same polarity as the dispersed particle or solvent easily solving the pigment may be used.

The conventional cleaning mechanism of the image forming apparatus set forth above employs the roll form cleaning means. The conventional roll type cleaning means merely removes the residual ink on the intermediate transfer body by coating the ink component on the roll for removing the ink utilizing the fact that binding power between the ink component on the cleaning roll and the residual ink on the intermediate transfer body is greater than that between the residual ink and the surface of the intermediate transfer body. However, on the surface of the cleaning roll, impurities other than the ink, substances contained in the ink component and degrading transfer performance, paper dust from the printing paper and so forth may deposit to lower cleaning performance. On the other hand, even assuming that the substance deposited on the surface of the cleaning roll is only ink, the ink amount is not uniform over the axial direction of the roll in some images. This forms irregularities on the surface of the cleaning roll and causes a loose fit between the cleaning roll and the intermediate transfer body resulting in cleaning failure.

SUMMARY OF THE INVENTION

Therefore, it is an object of the present invention to provide a cleaning mechanism for an image forming apparatus which can assure stable cleaning performance, and constantly maintain surface conditions of an intermediate transfer body and a photoconductor to obtain satisfactory quality of printed products.

According to one aspect of the present invention, a cleaning mechanism of an image forming apparatus which transfers an ink or a toner image formed on a photoconductor to a roll form intermediate transfer body and then transfers to a printing medium for obtaining a printed product, the cleaning mechanism comprises:

- a cleaning roll being contacted with the intermediate transfer body under pressure with a predetermined load and rotated with firm contact with the intermediate transfer body for removing residual ink, toner or impurity on the intermediate transfer body after a transfer process; and
- a sheet member being urged onto the cleaning roll for slip contact with a predetermined load.

In the construction set forth above, a relative speed may be provided between the cleaning roll and the sheet member for slip contact to transfer ink or impurity from a surface of the cleaning roll to the sheet member.

According to another aspect of the invention, a cleaning mechanism of an image forming apparatus which transfers an ink or a toner image formed on a photoconductor to a roll form intermediate transfer body and then transfers to a printing medium for obtaining a printed product, the cleaning mechanism comprises:

- a cleaning roll being contacted with the intermediate transfer body under pressure with a predetermined load and rotated with firm contact with the intermediate transfer body for removing residual ink, toner or impurity on the intermediate transfer body after a transfer process; and
- a back-up roll arranged in opposition to the cleaning roll;
- a sheet member being inserted between the back-up roll and the cleaning roll and slip-contacting with the cleaning roll;
- a feeding roll feeding the sheet member wound thereon;
- a take-up roll taking up the sheet member;
- a housing receiving the back-up roll, the sheet member, the feeding roll and the take-up roll; and
- an actuator connected to the housing and driving the sheet member toward and away from the cleaning roll for establishing and releasing slip contact therebetween.

A heat source, such as a halogen lamp or the like may be built into the cleaning roll for differentiating a surface temperature of the cleaning roll from a surface temperature of the intermediate transfer roll for providing large binding force with an ink for the cleaning roll.

Liquid supply means for supplying a liquid serving as a lubricant and a cleaning aiding agent to a sheet member, may be arranged within the housing. The liquid may be one of water, isopropyl alcohol and an insulative agent.

The sheet member may be in endless form.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscurity of the present invention.

Figure 1:
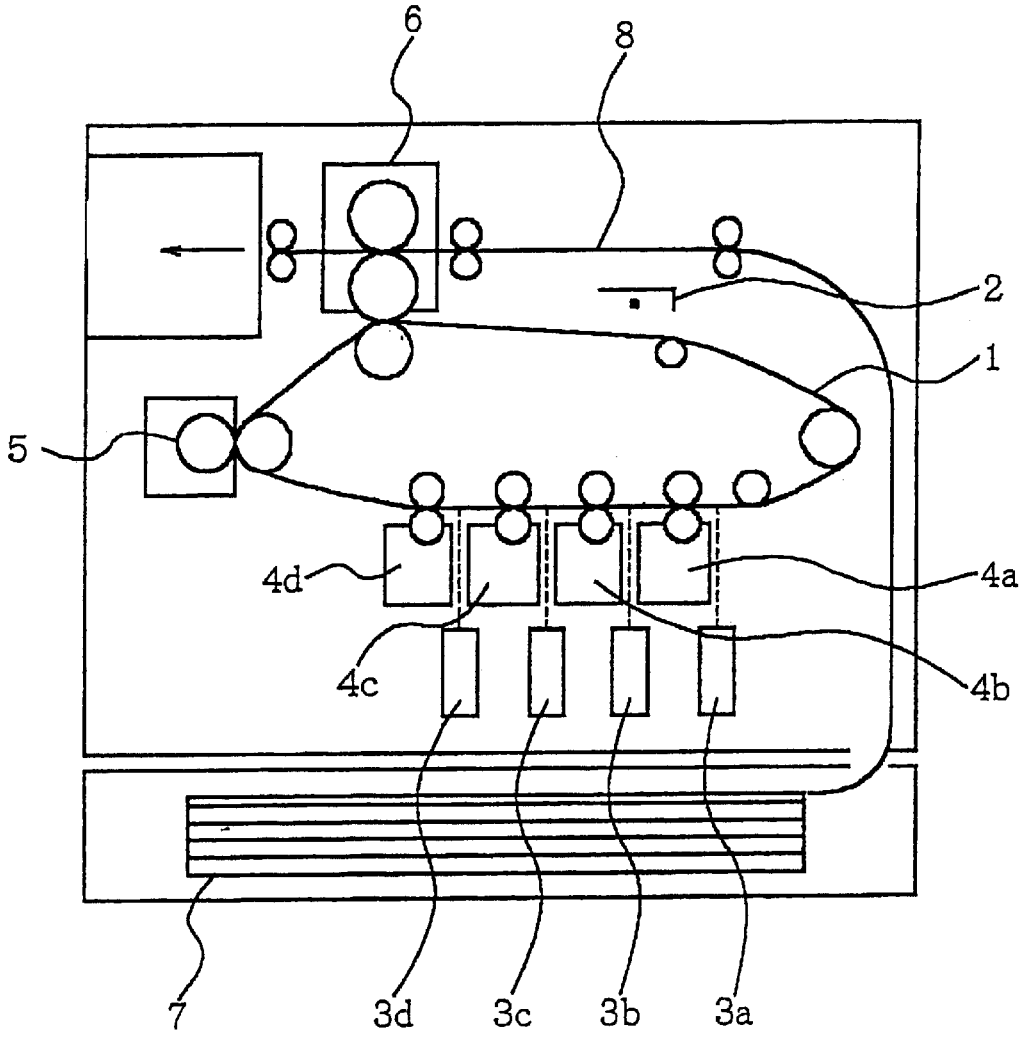
FIG. 1 is a diagrammatic illustration showing an overall construction of one embodiment of a cleaning mechanism for an image forming apparatus according to the present invention.

FIG. 1 is a diagrammatic illustration showing an overall construction of an image forming apparatus incorporating the preferred embodiment of a cleaning mechanism according to the present invention. FIG. 1 illustrates a color electrophotographic printer as one example of the image forming apparatus. However, the present invention should be applicable for color/monochrome electrophotographic printer, facsimile machine, copy machine and so forth. In FIG. 1, around a photoconductor 1 are provided a charging portion 2, an exposure portion 3, a developing portion 4, an ink drying portion 5 and a transferring and fixing portion 6.

Since the shown embodiment illustrates a color printer, the exposure portion 3 and the developing portion 4 are respectively consisted of exposure portions 3*a*, 3*b*, 3*c* and 3*d* and developing portions 4*a*, 4*b*, 4*c* and 4*d* adapted for respective colors of inks of yellow, magenta, cyan and black. By means of these mechanisms, a sequence of electrophotography process is performed to form an image on a printing paper 8 fed from a paper feeding hopper 7.

Figure 2:
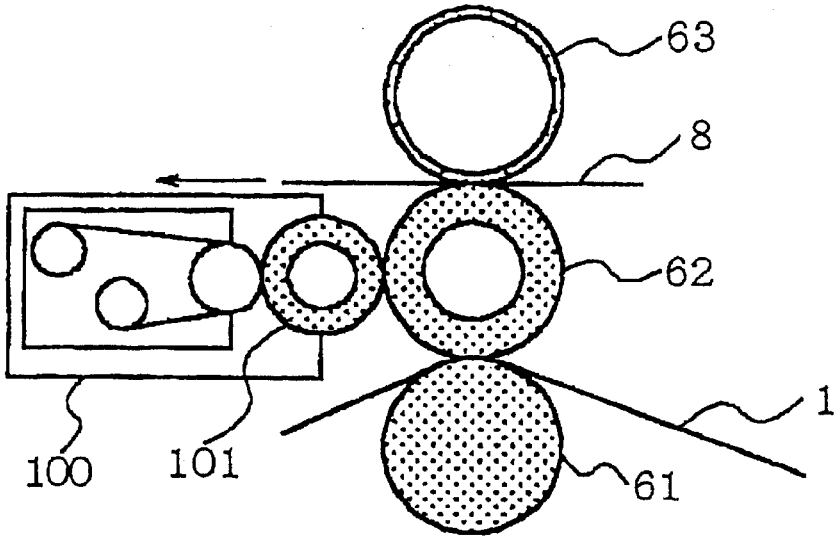
FIG. 2 is an illustration showing an image transfer portion and a fixing portion incorporating the preferred embodiment of the cleaning mechanism according to the present invention.

FIG. 2 is an illustration showing a construction of the transferring and fixing portion 6, to which the cleaning mechanism according to the present invention is applied. The photoconductor 1 is transferred between a pair of rolls contacted under pressure and between an intermediate transfer body 62 and a transfer back-up roll 61. An ink image on the photoconductor 1 is transferred to the intermediate transfer body 62. On the other hand, onto the intermediate transfer body 62, a fixing roll 63 is contacted under pressure. By feeding the printing paper 8 between these rolls, the ink image on the intermediate transfer body 62 is transferred to the printing paper 8. The intermediate transfer body 62 constantly transfers the ink from the photoconductor 1 to the printing paper 8 upon printing. However, it is quite difficult to constantly transfer the ink image from the intermediate transfer body 62 to the printing paper 8 at a transfer efficiency of 100%. Therefore, the intermediate transfer body 62 constantly holds possibility to be contaminated. Accordingly, in order to clean up the residual ink image or impurity on the intermediate transfer body 62, the preferred embodiment of the cleaning mechanism 100 according to the present invention is arranged.

Figure 3:
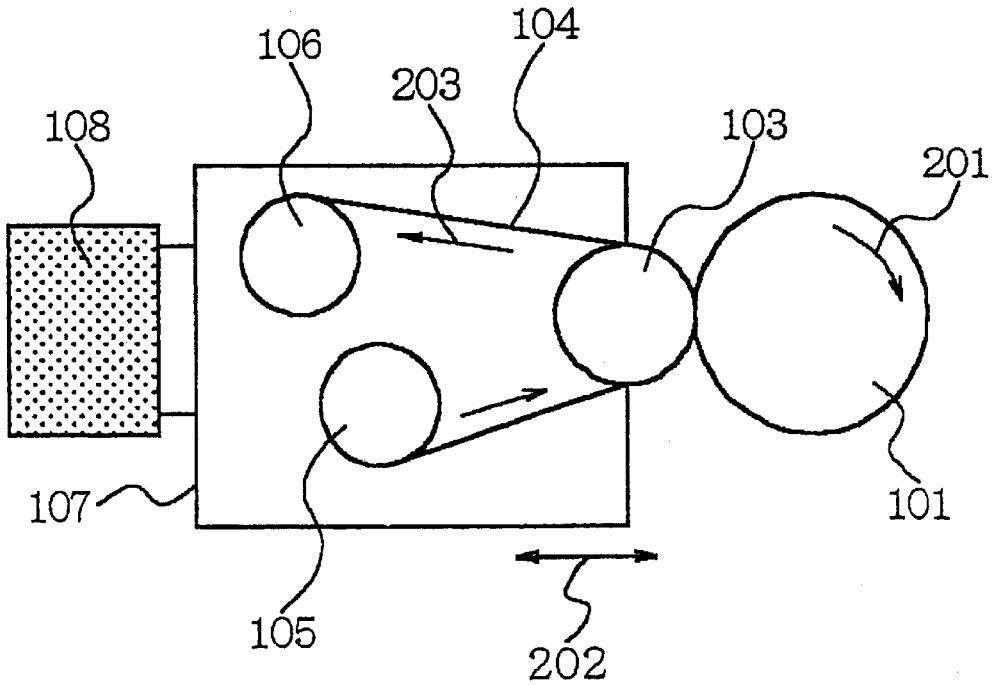
FIG. 3 is a diagrammatic side elevation showing one embodiment of a cleaning mechanism for an image forming apparatus according to the present invention.

FIG. 3 is a diagrammatic side elevation showing the preferred embodiment of the cleaning mechanism 100 according to the present invention. The cleaning mechanism is constructed with a back-up roll 103 arranged in opposition to a cleaning roll 101, a sheet member 104 disposed between the back-up roll 103 and the cleaning roll 101 for cleaning the cleaning roll 101, a feeding roll 105 for feeding the sheet member 104 wound thereon, a take-up roll 106 taking up the sheet member 104 passed between the back-up roll 103 and the cleaning roll 101, a housing 107 receiving the back-up roll 103, the sheet member 104, the feeding roll 105 and the take-up roll 106, and an actuator 108 connected to the housing for driving the latter for reciprocal movement in a direction shown by an arrow 202 and thus for movement toward and away from the cleaning roll 101.

During a printing operation of the image forming apparatus, the housing 107 is moved away from the cleaning roll 101 by the actuator 108. In this condition, the intermediate transfer body 62 is driven to rotate by the photoconductor 1. Furthermore, the cleaning roll 101 in pressure contact with the intermediate transfer body 62 is also driven to rotate.

During a printing operation, stains and impurities will be deposited on the surface of the cleaning roll 101 which cleans the intermediate transfer body 62. When only ink is deposited on the surface of the cleaning roll 101, since a binding force between ink is greater than that between the ink and the intermediate transfer body 62, good cleaning performance can be maintained. However, in practice, impurities other than ink, such as substances contained in the ink component that interfere with transfer performance, paper dust from the printing paper, and so forth may deposit on the surface of the cleaning roll 101 to degrade cleaning performance. On the other hand, even if only ink deposits on the surface of the cleaning roll 101, the amount of ink depositing on the surface of the cleaning roll will not be uniform in the axial direction of the roll to form unevenness on the surface of the cleaning roll 101 to cause contact failure between the cleaning roll 101 and the intermediate transfer body 62 to cause cleaning failure.

Therefore, upon completion of printing of a predetermined number of sheets, cleaning of the cleaning roll 101 is performed by means of the sheet member 104. Namely, upon completion of printing of the predetermined number of sheets, the actuator 108 is activated to move the back-up roll 103 together with the housing 107 frontwardly to contact the sheet member 104 onto the cleaning roll 101 under pressure. By rotating the intermediate transfer body 62 at this condition, the cleaning roll 101 is driven to rotate in the direction of arrow 201 to cause a relative speed between the cleaning roll 101 and the sheet member 104 to establish a slip contacting state. By this, the substance on the cleaning roll 101 is removed and transferred to the sheet member 104.

After performing cleaning for a given period, the back-up roll 103 is moved away from the cleaning roll 101 together with the housing 107 by means of the actuator 108. Also, the take-up roll 106 is driven to rotate for a predetermined angle to take up the sheet member 104 in the direction of arrow 203. With such construction, cleaning of the cleaning roll 101 at the next cleaning operation can be performed with a clean surface of the sheet member 104.

When a cleaning operation is performing during a printing operation, friction load and load fluctuation due to slip contact between the sheet member 104 and the cleaning roll 101 becomes significant to cause fluctuations in speed (irregularity) upon image formation. Therefore, the cleaning of the cleaning roll 101 by means of the sheet member 104 is regularly performed at an interval between printing scan. However, if the friction load and load fluctuation can be made reasonably small, the cleaning by the sheet member 104 may be constantly performed even during printing.

In the shown embodiment, as a material of the intermediate transfer body 62, a silicon rubber having hardness in a range of 50 to 75 (JIS-A) is used. As a material of the cleaning roll 101, a material having greater binding force than the silicon rubber forming the intermediate transfer body 62 is required. Therefore, it is desirable to form the cleaning roll 101 with a material, such as another silicon rubber or the like having greater binding force with the ink than that between the silicon rubber of the intermediate transfer body 62. On the other hand, when a substance contained in the ink or ink component and interfering or degrading transfer performance is present between the intermediate transfer body 62 and the cleaning roll 101 or between the intermediate transfer body 62 and the ink on the cleaning roll 101, and if the substance has a property to be easily transferred to one having higher or lower temperature, greater binding force than that of the intermediate transfer body 62 can be provided for the cleaning roll 101 by differentiating the surface temperature of the cleaning roll 101 from that of the intermediate transfer body 62 by incorporating a heat source, such as a halogen lamp or the like within the cleaning roll 101.

A material of the sheet member 104 for performing cleaning of the cleaning roll 101 may be wettable material, such as a wrapping film, a non-woven fabric of fiber or resin, felt and the like.

Figure 4:
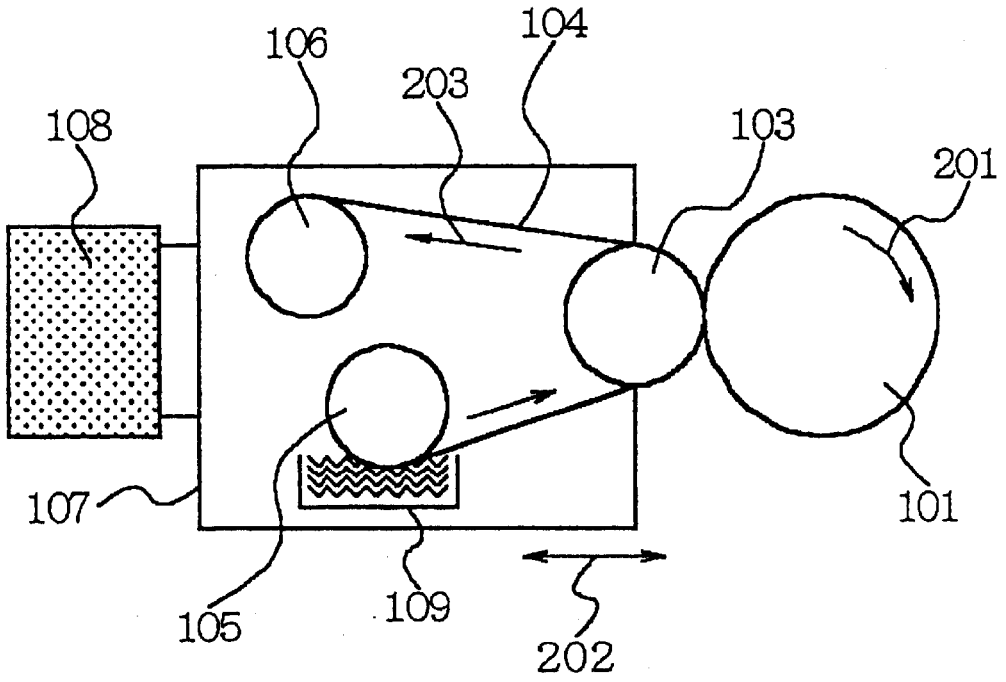
FIG. 4 is an illustration showing a modification of one embodiment of the embodiment of a cleaning mechanism for an image forming apparatus according to the present invention.

FIG. 4 shows a modification of the preferred embodiment of the cleaning mechanism according to the present invention. In the former embodiment, cleaning is performed simply by slip contact between the cleaning roll 101 and the sheet member 104. In contrast to this, in the shown modification in FIG. 4, a liquid supply means 109 is arranged within the housing 107 for supplying a lubricant and cleaning aiding agent for reduction of friction load in the slip contacting portion between the cleaning roll 101 and the sheet member 104 and enhancing cleaning performance. By automatically supplying a liquid to the sheet member 104 from the liquid supply means 109 at the feeding roll 105 or between the feeding roll 105 and the back-up roll 103, more stable cleaning performance can be obtained. As a liquid to be supplied from the liquid supply means 109, water, isopropyl alcohol, an insulative solvent or the like.

Figure 5:
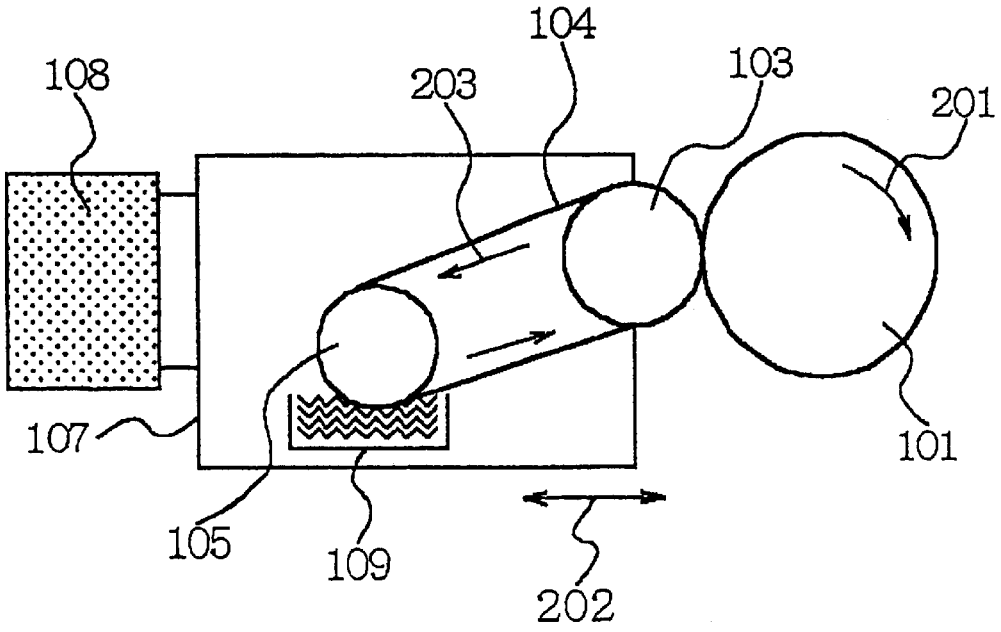
FIG. 5 is an illustration showing another modification of one embodiment of the embodiment of a cleaning mechanism for an image forming apparatus according to the present invention.
Figure 6:
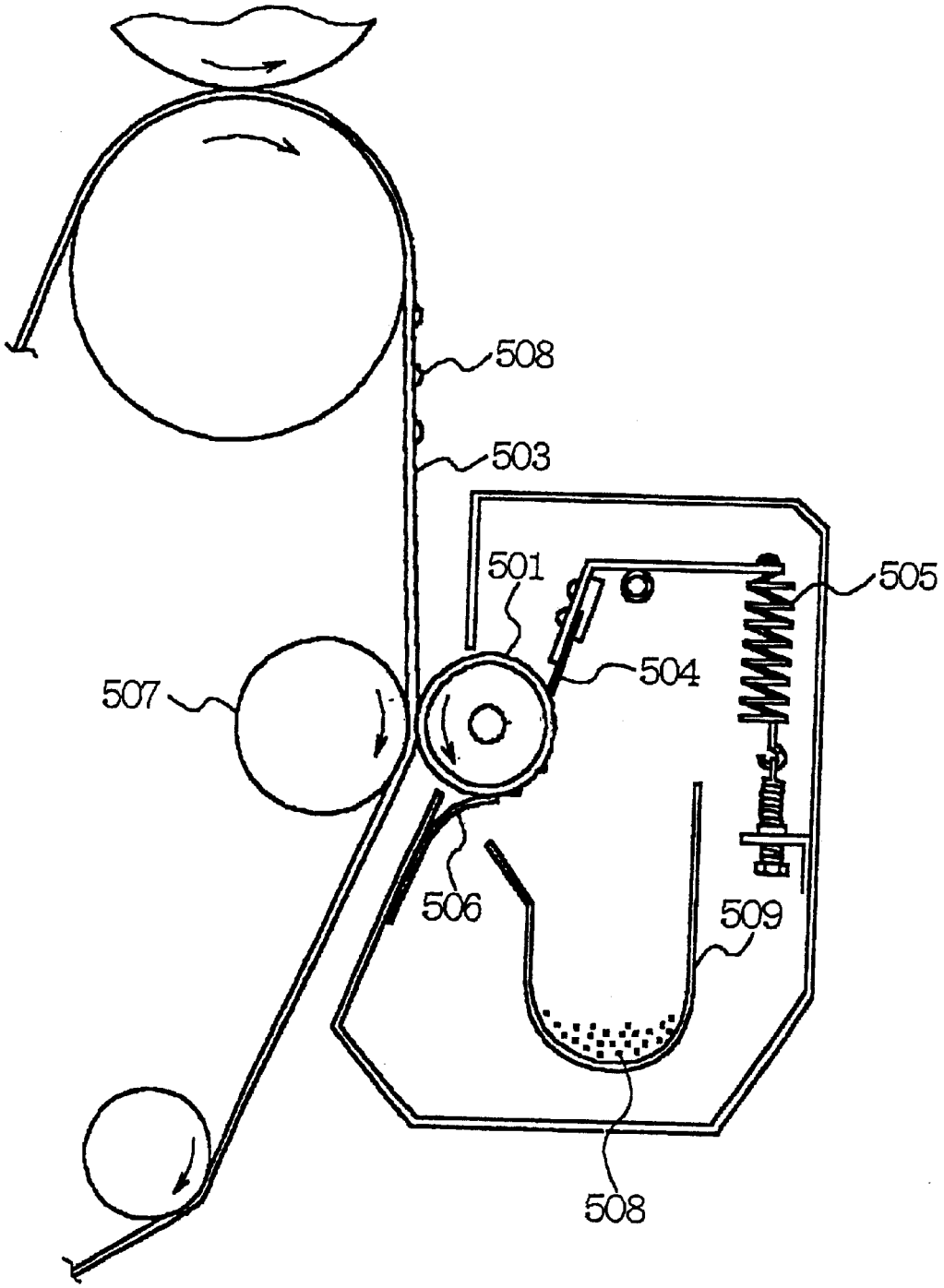
FIG.6 (PRIOR ART)
FIG. 6 is a side elevation showing the first prior art.
Figure 7A:
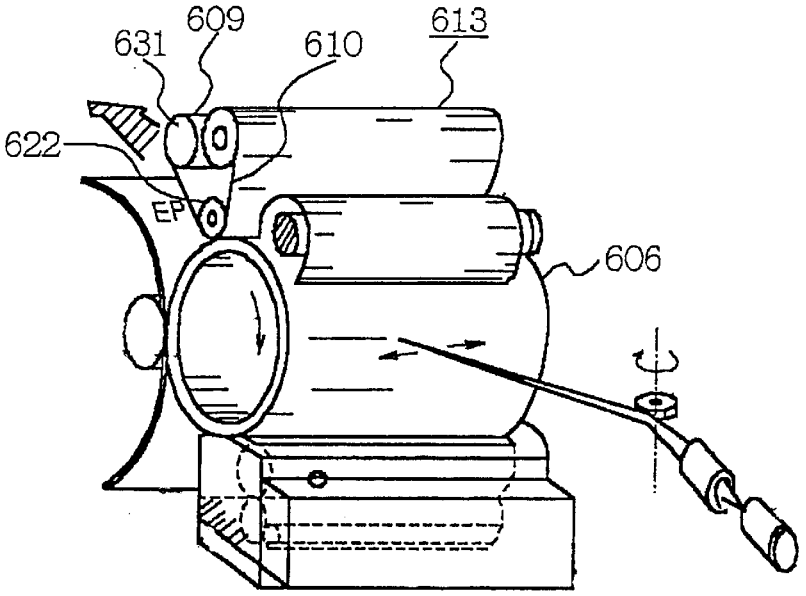
FIG.7A (PRIOR ART)
FIGS. 7A and 7B are a perspective view and a side elevation showing the second prior art.
Figure 7B:
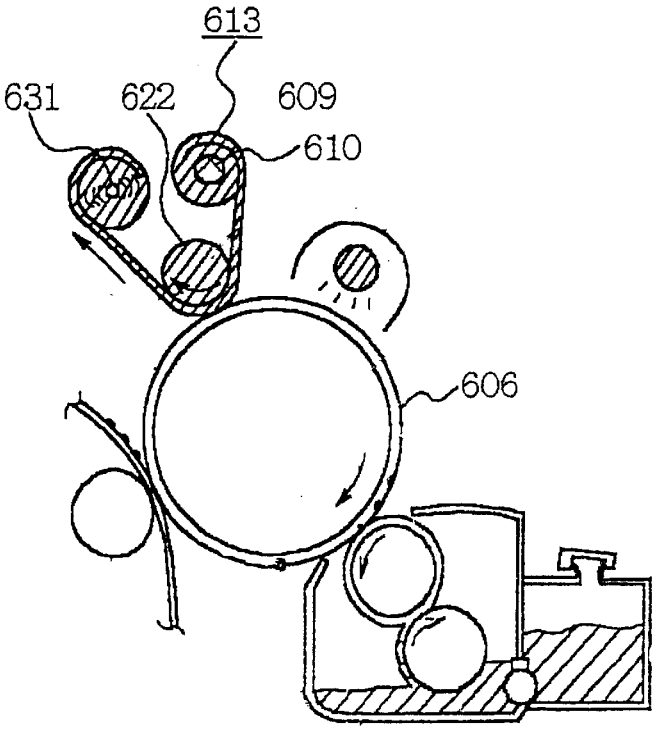
FIG.7B (PRIOR ART)

FIG. 5 shows another modification of the preferred embodiment of the cleaning mechanism according to the present invention. In FIG. 5, the sheet member 104 is formed into an endless form for permitting repeated use. In this case, after cleaning the sheet member 104, residual substance on the sheet member 104 (e.g. residual ink or the like) may be washed out in certain extent by the liquid supplied from the liquid supply means 109 to certainly maintain satisfactory cleaning performance.

As set forth above, the cleaning mechanism of the image forming apparatus according to the present invention constantly performs cleaning of the intermediate transfer body by means of the cleaning roll, and regularly performs cleaning of the cleaning roll by means of the sheet member to certainly provide stable cleaning performance. The surface conditions of the intermediate transfer body and the photoconductor which is collected the ink or the like by the intermediate transfer body can be maintained clean to attain stable image formation.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A cleaning mechanism of an image forming apparatus which transfers an ink or a toner image formed on a photoconductor to a roll form intermediate transfer body and then transfers the image to a printing medium for obtaining a printed product, said cleaning mechanism comprising:

a cleaning roll being contacted with said intermediate transfer body under pressure with a predetermined load and rotated with firm contact with the intermediate transfer body for removing residual ink, toner or impurity on said intermediate transfer body after a transfer process;

a sheet member being urged onto said cleaning roll for slip contact with a predetermined load; and liquid supply means for supplying a liquid serving as a lubricant and a cleaning aiding agent to said sheet member, said liquid supply means being arranged within a housing for said sheet member.

2. A cleaning mechanism of an image forming apparatus as set forth in claim 1, wherein a relative speed is provided between said cleaning roll and said sheet member for slip contact to transfer ink or impurity from a surface of said cleaning roll to said sheet member.

3. A cleaning mechanism of an image forming apparatus which transfers an ink or a toner image formed on a photoconductor to a roll form intermediate transfer body and then transfers the image to a printing medium for obtaining a printed product, said cleaning mechanism comprising:

a cleaning roll being contacted with said intermediate transfer body under pressure with a predetermined load and rotated with firm contact with the intermediate transfer body for removing residual ink, toner or impurity on said intermediate transfer body after a transfer process;

a back-up roll arranged in opposition to said cleaning roll;

a sheet member being inserted between said back-up roll and said cleaning roll and slip-contacting with said cleaning roll;

a feeding roll feeding said sheet member wound thereon;

a take-up roll taking up said sheet member;

a housing receiving said back-up roll, said sheet member, said feeding roll and said take-up roll;

an actuator connected to said housing and driving said sheet member toward and away from said cleaning roll for establishing and releasing slip contact therebetween; and liquid supply means for supplying a liquid serving as a lubricant and a cleaning aiding agent to said sheet member, said liquid supply means being arranged within the housing.

4. A cleaning mechanism of an image forming apparatus as set forth in claim 3, wherein said liquid is one of water, isopropyl alcohol and an insulative solvent.

5. A cleaning mechanism of an image forming apparatus as set forth in claim 3, wherein said sheet member is in endless form.

* * * * *